US006032885A

United States Patent [19]

Ellery

[11] Patent Number: 6,032,885

[45] Date of Patent: Mar. 7, 2000

[54] CONTROL SYSTEM FOR A REPULPING APPARATUS

[75] Inventor: John M. Ellery, Ponte Vedra Beach, Fla.

[73] Assignee: Beloit Technologies, Inc., Wilmington, Del.

[21] Appl. No.: 08/961,930

[22] Filed: Oct. 31, 1997

[51] Int. Cl.[7] ..... B02C 25/00

[52] U.S. Cl. ..... 241/34; 241/46.17

[58] Field of Search ..... 241/34, 30, 46.17, 241/46.11

[56] References Cited

FOREIGN PATENT DOCUMENTS 1409839 10/1975 United Kingdom ..... 241/46.17

*Primary Examiner*—Mark Rosenbaum

[57] ABSTRACT

A control system for a repulping apparatus having a vat containing a pulp and water slurry and a rotatable blade for mixing the pulp and water to form the slurry. A feed apparatus moves the pulp into the vat and a feed indicator senses the entry of the pulp into the vat and produces an entry signal indicative of the pulp entering the vat. A controller responsive to the pulp entry signal calculates the volume of water to be added to the vat and the water flow rate to provide a predetermined consistency in the slurry and produces a signal representative of the calculated volume of water. A water volume control receives and is responsive to the calculated water volume signal to control the admitting of water into the vat. The controller also produces a signal representative of the calculated rate of flow. A flow control is responsive to the calculated water volume signal and to the calculated rate of flow signal to admit water into the vat at the calculated rate of flow. The slurry mixed in the vat is discharged to a dump chest and a dump chest level sensor monitors the level of the slurry in the dump chest. The dump chest level sensor produces a signal to the feed apparatus to increase or decrease the rate of pulp delivery into the vat depending on the level of the slurry in the dump chest.

13 Claims, 2 Drawing Sheets

CONTROL SYSTEM FOR A REPULPING APPARATUS

FIELD OF THE INVENTION

The present invention relates to a repulping apparatus and, in particular, to a repulping apparatus control system for maintaining consistency in pulp slurry produced by the repulping apparatus.

BACKGROUND OF THE INVENTION

In the production of paper and other cellulose pulp products, the process sometimes utilizes pulp that has been previously produced. Thus, in converting the pulp to a finished product, it must be repulped. A problem that has existed for a long time in the repulping process is the maintaining of a constant controlled consistency in the slurry produced by the repulping apparatus. A repulping apparatus includes a mechanical rotor blade rotating in a vat of pulp and water slurry which is produced by the mixing and shearing action of the rotor. The term "consistency" is defined in the industry as being the weight of fiber in the liquid, e.g., the pounds of fiber per 100 pounds of water. The difficulties in controlling the output consistency of the slurry are due to variations inherent in the process which are difficult to control. These variations include variable pulp bale weights depending on the source supplier, the moisture content of the pulp used in the repulping process, the volume of dilution water admitted into the pulper vat, the rate of addition of dilution water into the vat, and the dwell time in the pulper vat.

The instant invention is an improvement in the control for a repulping apparatus to take into account the variables mentioned above and produce a pulp and water slurry with a uniform consistency.

SUMMARY OF THE INVENTION

It is a general objection of the invention to provide a control system for a repulping apparatus which produces a uniform consistency in the slurry produced by the repulper. It is a further object of the invention to provide a control for a repulping apparatus in which the volume of water and rate of water flow for a particular weight of pulp added to the pulp vat is calculated as part of the control function and the necessary dilution water added at the volume and at the rate calculated. It is another objection of the invention to provide a repulping apparatus control in which the rate of producing slurry in the pulping vat is responsive to the level of the slurry in the output dump chest. It is still another object of the invention to provide a repulping apparatus control in which the consistency of the slurry discharged from the pulping vat is determined and modified if the consistency is not as desired.

The control system of the invention is utilized in a repulping apparatus having a vat containing a pulp and water slurry and a rotating rotor blade for mixing the pulp and water to form the slurry. A feed apparatus moves the pulp into the vat and a feed indicator senses the entry of the pulp into the vat and produces an entry signal indicative of the pulp entering the vat. A controller responsive to the pulp entry signal calculates the volume of water to be added to the vat to provide a selected predetermined consistency in the slurry in the vat and produces a signal representative of the calculated volume of water. A water volume control receives and is responsive to the calculated water volume signal to control the admitting of water into the vat.

The controller is also responsive to the entry signal to calculate the rate of flow of water into the vat and produce a flow rate signal representative of the calculated rate of flow. A flow control is responsive to the calculated water volume signal and to the calculated rate of flow signal to admit water into the vat at the calculated rate of flow. A volume control also senses the actual volume of water, and admits water into the vat equal to the calculated water volume.

The flow control includes a valve mechanism having a discharge into the vat and being movable between open and closed conditions to control the admission of water into the vat. The volume control further includes comparison means for comparing the signal representative of the calculated volume of water and a signal representative of the actual volume of water and produces a signal proportional to the difference in volume between the actual and calculated volume of water signals. The difference signal is used by the volume control to vary the volume of water admitted into the vat.

The slurry mixed in the vat is discharged to a dump chest and a dump chest level control monitors the level of the slurry in the dump chest. The dump chest level control produces a signal to the feed apparatus to increase or decrease the rate of pulp delivery into the vat. Thus, the level of the dump chest, as determined by the converting process demand for slurry from the dump chest, determines the rate at which pulp is moved into the vat and thereby the volume of water and rate of water flow into the vat for mixing the slurry as calculated by the controller. Also, a vat level control senses the level of the slurry in the vat and, as the slurry level rises in the vat, the vat level control causes the slurry to be discharged from the vat into the dump chest. If the slurry thus discharged into the dump chest causes the dump chest level to rise beyond its desired level, the dump chest level control will, in turn, cause the amount of pulp and water entering the vat to decrease to thereby lower the level of the vat to a point where the vat level control causes a decrease in slurry discharged from the vat into the dump chest. Thus, the dump chest and its level control provide a feedback arrangement which maintains control of the repulping apparatus on a relatively continuous constant basis.

BRIEF DESCRIPTION OF THE DRAWINGS

The above and further objects, features and advantages of the invention will become apparent upon consideration of the following detailed description taken in conjunction with the accompanying drawings as follows.

DESCRIPTION OF THE PREFERRED EMBODIMENT

Figure 1:
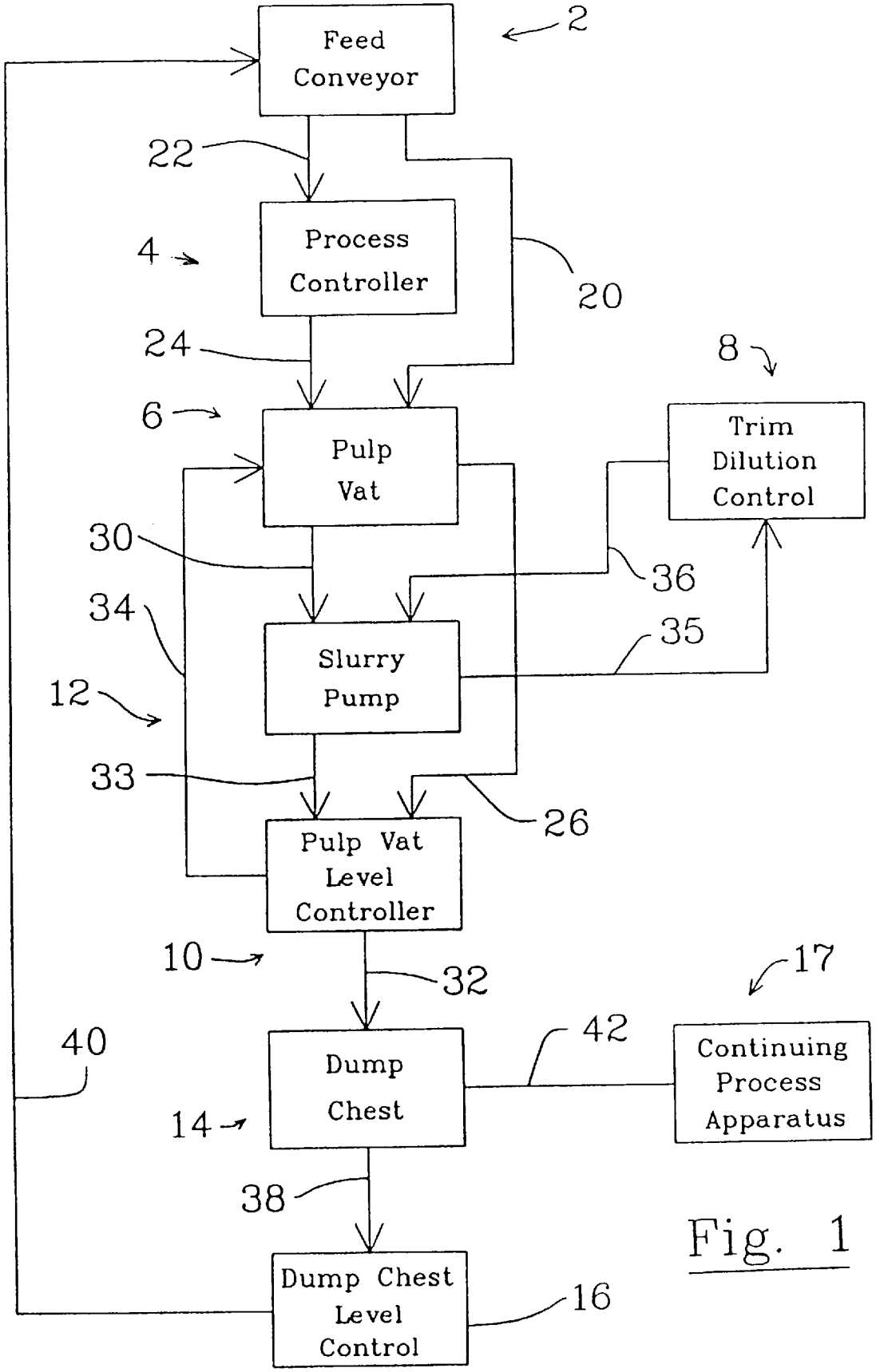
FIG. 1 is a schematic block diagram of the control system and operating steps of the repulping apparatus.

With reference to FIG. 1 in which a schematic block diagram of the repulping process is illustrated, a feed conveyor 2 delivers pulp to the pulp vat 6 as indicated by line 20. At approximately the same time, the process control 4 receives an indication on line 22 that the feed conveyor has delivered the pulp to the vat 6. As a result of receiving the signal that pulp has been delivered to the vat 6, the process control 4 admits water through the pipe line 24 into the pulp vat in which a pulp and water slurry is formed. A slurry pump 12 pumps slurry from the vat 6 through a pulp vat level control 10 to either a slurry dump chest 14 through pipes 30, 33 and 32 or back to the vat 6 through pipes 30, 33 and 34 as determined by the level control 10. The pulp vat level control 10 monitors the level of the slurry in the pulp vat 6 and receives a signal on line 26 indicative of the level of the slurry in the pulp vat 6. If the slurry in the pulp vat 6 is at or above a selected predetermined level, the pulp vat level control 10 will direct slurry being pumped by the slurry pump 12 through pipe 32 to the dump chest 14. If the slurry in the vat 6 is below the selected predetermined level, the pulp vat level control 10 will direct the slurry being pumped back to the vat 6 through pipeline 34.

A trim dilution control 8 monitors the consistency of the slurry in the pipeline 30 from the pulp vat to the slurry pump and receives a signal on line 35 indicative of the slurry consistency. If the slurry consistency is greater than a selected predetermined value, the trim dilution control 8 will admit water through pipeline 36 to the pulp vat 6 to cause a decrease in the slurry consistency.

A dump chest level control 16 monitors the slurry level in the dump chest 14 and receives a signal indicative of the dump chest slurry level on line 38. If the dump chest slurry level is below a selected predetermined value, the dump chest level control 16 will transmit a signal on line 40 to the feed conveyor 2 which causes the feed conveyer to increase its speed of delivery of pulp into the pulp vat 6. If the dump chest slurry level is above the predetermined value, the dump chest level control 16 will transmit a signal to the feed conveyor which causes the feed conveyor 2 to slow its delivery of pulp into the vat 6. A pipeline 42 discharges the dump chest 14 to the continuing process apparatus 19 in which the next step in the utilization of the slurry is carried out.

Figure 2:
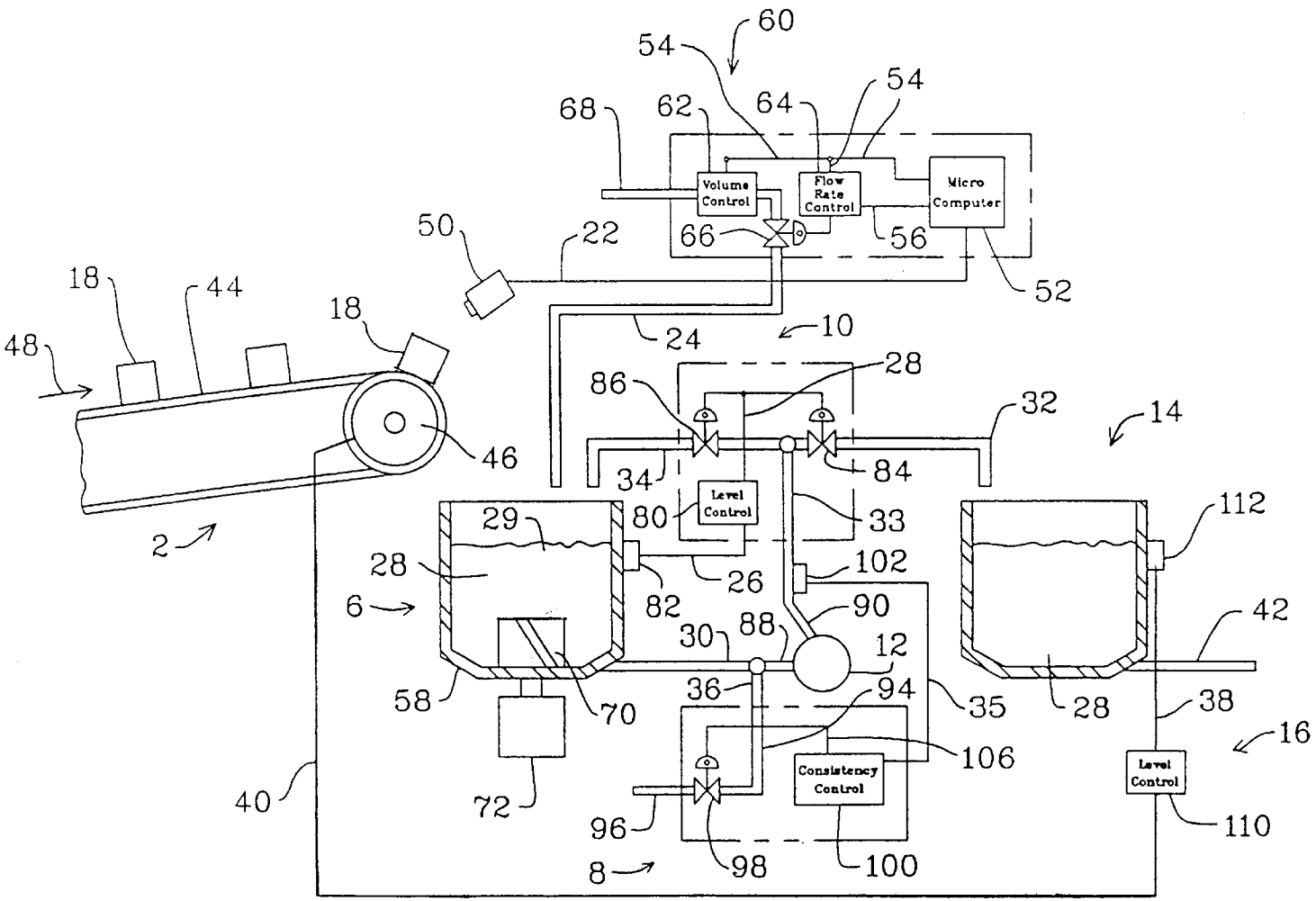
FIG. 2 is a schematic diagram of the repulping apparatus and the control system according to the invention.

With reference to FIG. 2, in which the repulping apparatus is illustrated in greater detail, the pulp vat 6 includes a tank 58 containing the slurry 28 and slurry mixing rotor blades 70 within the tank 58 rotatably driven by an electric motor 72. The feed conveyor 2 comprises a continuous belt 44 driven in the direction of arrow 48 by an electric motor drive 46. The motor drive 46 is responsive in its drive speed of the belt 44 to a signal on line 40 from the dump chest level control 16. It may be noted that although a belt type feed conveyor 2 has been described herein, other types of conveyors may also be suitable. The feed conveyor 2 carries a pulp bale 18 or, more typically, a series of pulp bales 18, toward a point on the feed conveyor 2 at which the pulp bales will drop into the pulp vat 6. Each pulp bale may be, for example, multiple layers of pulp board which have been previously banded together and unbanded at the time of their delivery onto the feed conveyor 2. As each bale 18 leaves the conveyor to enter the pulp vat 6, it passes a bale-in-pulper sensor 50. The sensor 50 is a part of the process controller 4 and provides a signal on line 22 to the process controller 4 indicating that a bale 18 of pulp has been delivered into the vat 6. In response to the receipt of the signal from sensor 50, the process controller 4 will admit water through pipe 24 into the vat 6 as will be described hereinafter in greater detail.

The process controller 4 includes a microcomputer 52 and the signal received on line 22 from the bale in pulper sensor 50 is received by the microcomputer 52. The microcomputer 52 includes a microprocessor, a memory, and input and output interface units, which are well-know types of devices and are not shown, and which receive or transmit information on lines 22, 54 and 56 and calculate and/or convert from one form to another the information received and transmitted on such lines. It may be noted that each identified line herein represents one or more electrical conductors as needed for functioning of the control system. Upon receipt of the signal on line 22, the microcomputer 52 will calculate the water volume required, e.g., gallons of water per bale, to be admitted into the pulp vat 6 and also the rate of addition of the calculated water volume to be added into the vat 6 to provide a predetermined desired consistency of the slurry 28. The volume or gallons per bale of water will be in accord with the equation:

$$\text{gallons/bale} = \begin{array}{l}(100/\text{desired pulping consistency in \%} - 1)\\ (1/8.34)(\text{actual bale weight} - (\text{actual bale}\\ \text{weight in lbs.} \times \text{bale moisture in \%}))\end{array}$$

Following calculation of the volume of water to be added, the microcomputer 52 calculates the rate at which the calculated volume of water is to be added in accord with the following equation:

$$\text{water rate of addition}=(\text{gallons/bale})\ ((\text{maximum tons/day}\times 2{,}000\ \text{lb. per ton})/\text{actual bale weight})/\text{minutes per day}).$$

In the equations, the variables "desired pulping consistency" and "bale moisture" are respectively the predetermined desired pulping consistency and the amount of moisture in the pulp board bales as supplied to the repulping apparatus. The numeral "8.34" is the weight of a gallon of water in pounds. The variables "bale weight" and "maximum tons per day" may be variables obtained from sensors which do not comprise part of the instant invention or they may be predetermined values which are entered manually in the microcomputer 52.

In addition to the microcomputer 52, the process controller 4 includes a flow controller 60 comprising a water volume control 62 and a water flow rate control 64. The flow rate control 64 further includes a primary dilution valve 66 having an open and closed condition and which discharges through pipeline 24 into vat 6. A pipeline 68 is connected to a source of water (not shown). The water volume control 62 receives a reference volume signal on line 54 representative of the calculated volume of water to be admitted through the valve 66 and pipeline 24 into the vat 6. The volume control 62 also senses the actual volume of water passing through the pipe line 68 and valve 66 to the vat 6 and produces a signal representative of the actual water flow volume. The flow rate control 64 receives a reference flow rate signal representative of the calculated flow rate from the microcomputer 52 and also receives the reference signal representative of the calculated volume of water from the microcomputer 52. In response to receipt of the reference signal representative of the calculated rate of flow, the flow rate control 62 transmits a signal to the valve 66 which causes the valve 66 to open such that the actual flow rate of the water through the valve 64 into the vat 6 equals the calculated flow rate. When the actual volume of water as measured by the volume control 62 equals the calculated volume of water, the volume control 62 will transmit a matching signal to the flow rate control 64 which causes the latter to close the primary dilution valve 66.

The pulp vat level controller 10 includes a level control 80, a level sensor 82 mounted on the vat 6 for sensing the level 29 of the slurry 28 in the vat 6, a level control valve 84, and a recycle valve 86. An electric motor driven slurry pump 12 having a suction inlet connected to pipe 30 and a discharge outlet connected to pipe 33 pumps slurry 28 from the vat 6. The level control 80 contains a reference signal representative of a desired predetermined level of the slurry in vat 6 and receives a signal on line 26 from the level sensor 82 indicative of the actual level 29 of the slurry in the vat 6. A comparison is made by the control 80 and, if the value of the actual level signal from the sensor 82 is less than the reference level signal, the level control 80 will cause the recycle valve 86 to move to a more open position and the level control valve 84 to move to a more closed position to thereby cause slurry 28 being pumped by the slurry pump 12 through pipes 30 and 33 to return to the vat 6 through the recycle valve 86. If the signal representative of the actual level 29 of the slurry 28 in the vat 6 from the sensor 82 is greater than the reference vat level signal, the level control 80 will control the recycle valve 86 to move to a more closed position and the level control valve 84 to move to a more open position to cause the slurry 28 being pumped through the pipe 30 by the slurry pump 12 to move through the pipe 32 to the slurry dump chest 14. In this manner the pulp vat level controller 10 maintains the level 29 of the slurry 28 in the vat 6 at approximately the desired predetermined level.

The trim dilution control 8 includes a slurry consistency sensor 102 located on the pipeline 33 at the discharge outlet of the slurry pump 12, a consistency control 100, and a trim dilution valve 95. The consistency control 100 contains a reference signal representative of a predetermined desired slurry consistency. The consistency sensor 102 senses the consistency of the slurry at the discharge outlet of the slurry pump 12 and transmits a signal representative of the actual slurry consistency on line 35 to the consistency control 100. The consistency control 100 compares the reference and actual consistency signals and if the actual consistency signal is greater than the reference consistency signal, the control 100 transmits a signal on line 106 to the trim dilution valve 98 which causes the valve 98 to open and admit water from a source (not shown) through pipe lines 96 and 94 to the suction inlet 88 of the slurry pump 12.

The dump chest level controller 16 comprises a level control 110 and a level sensor 112 for sensing the level 31 of the slurry 28 in the dump chest 14. The level sensor 112 is mounted on the dump chest 14 and connected to the level control by line 38. The level control 110 contains a reference signal representative of a desired predetermined level of the slurry 28 in the dump chest 14. The level sensor 112 senses the level 31 of the slurry in the dump chest 14 and produces a signal representative of such actual level 31 of the slurry in the dump chest and transmits this signal to the level control 110. Level control 110 compares the actual dump chest slurry level signal with the reference slurry level signal and, if the actual signal deviates from the reference level signal, the level control 110 transmits a signal on line 40 to the motor drive 46 of the feed 2 indicative of such deviation. If the deviation is such that the actual level representative signal indicates a level less than the level indicated by the reference level signal, the signal from the level control 110 to the motor 46 will cause the motor 46 to increase its speed to increase the rate of dumping pulp bales 18 into the vat 6. If the actual slurry reference level signal indicates a level greater than the level indicated by the reference slurry representative signal, the signal from the level control 110 to the motor 46 will cause the motor 46 to decrease its speed to decrease the rate of dumping of pulp bales 18 into the vat 6.

The repulper apparatus may function and carry out the repulping process continuously. As pulp bales 18 continue to be added to the pulp vat 6, additional slurry 28 is pumped by the slurry pump 12 to the dump chest 14. As the level 31 of the slurry in the dump chest rises or falls, a signal is sent to the feed conveyor 2 calling for it to respectively decrease or increase its speed of delivery of the pulp bales 18 to the vat 6. The feed conveyor speed will settle out at a speed that will deliver pulp to the vat 6 at a rate approximately equal to the demand from the dump chest 14.

It will be understood that the foregoing description of the present invention is for purposes of illustration only and that the invention is susceptible to a number of modifications or changes, none of which detail any departure from the spirit and scope of the present invention as defined in the hereto appended claims.

What is claimed is:

1. A repulping apparatus comprising:

a vat for receiving and containing a pulp and water slurry; said vat having a rotatable rotor therein:

feed means for moving pulp into the vat;

feed indicating means for sensing the entry of pulp into the vat and producing an entry signal indicating such entry;

controller means for admitting water into the vat and being responsive to the entry signal for calculating the volume of water to be admitted to the vat to provide a predetermined consistency in said slurry and producing a reference signal representative of the calculated volume of water; and volume control means responsible to the calculated volume reference signal for controlling the volume of water admitted into the vat.

2. The repulping apparatus according to claim 1 wherein:

the controller means is responsive to the entry signal to calculate the rate of flow of the water into the vat and produces a reference signal representative of the calculated rate of flow; and flow control means responsive to the calculated rate of flow reference signal to admit water into the vat at the calculated rate of flow.

3. The repulping apparatus according to claim 2 wherein the flow control means is responsive to the volume reference signal to admit said calculated volume of water into the vat at said calculated rate of flow.

4. The repulping apparatus according to claim 2 wherein the flow control means includes valve means movable between open and closed conditions to control the admission of water into the vat.

5. A repulping apparatus comprising:

a vat for receiving and containing a pulp and water slurry; said vat having a rotatable rotor therein;

feed means for moving the pulp into the vat;

feed indicating means for sensing the entry of pulp into the vat and producing an entry signal indicating such entry;

controller means responsive to the entry signal for calculating the volume of water to be added to the vat and the rate of flow of the volume of water into the vat to provide a predetermined desired consistency in said slurry and producing a reference signal representative of the rate of flow; and flow control means responsive to the reference signal representative of the calculated rate of flow to admit water at the calculated rate of flow into the vat.

6. The repulping apparatus according to claim 5 wherein:

the controller means produces a reference signal representative of the calculated volume of water; and the flow control means is responsive to the reference signal representative of the calculated volume of water to admit said calculated volume of water into the vat.

7. The repulping apparatus according to claim 6 further comprising:

volume control means including sensing means responsive to the reference signal representative of the calculated volume of water and to the flow of water to the vat to sense the actual volume of water flow to the vat and produce a signal representative of the actual volume of water flow;

the volume control means further comparing the reference signal representative of the calculated volume of water and the signal representative of the actual volume of water flowing to the vat and producing a matching signal when the reference signal representative of the calculated volume of water and the signal representative of the actual volume of water flow are equal; and wherein the flow control means includes valve means having an open and closed condition for controlling the flow of water to the vat, the flow control means being responsive to the matching signal to move the valve means from its open to its closed condition.

8. The repulping apparatus according to claim 6 further comprising:

a dump chest containing slurry received from the vat for further process use;

level control means for sensing the level of slurry in the dump chest and producing a level deviation signal if the dump chest slurry is not at a predetermined level; and wherein the feed means receives the level deviation signal and is responsive thereto to move pulp into the vat.

9. The repulping apparatus according to claim 5 further comprising:

a dump chest containing slurry received from the vat for further process use;

pipe means connected between the vat and the dump chest for conveying slurry from the vat to the dump chest;

consistency trim means for sensing the consistency of the slurry in the pipe means and producing an actual consistency signal representative of the slurry consistency;

consistency control means containing a reference consistency signal representative of a desired predetermined slurry consistency and being responsive to the actual consistency signal to compare the actual consistency signal and the reference consistency signal and produce a dilution signal if the actual consistency signal is greater than the reference consistency signal; and trim dilution valve means responsive to the dilution signal to add water to the slurry in the pipe means.

10. The pulping apparatus according to claim 5 further comprising:

vat level indicating means for sensing the level of the slurry in the vat and producing an actual vat level signal representative of such level;

vat level control means containing a reference vat level signal representative of a desired predetermined level of the slurry in the vat and being responsive to the actual vat level signal to compare the actual vat level signal and the reference vat level signal and produce a level adjustment signal if the actual and reference vat level signals are not equal; and vat level valve means responsive to the level adjustment signal to discharge slurry from the vat if the actual vat level signal is greater than the reference vat level signal or recycle to the vat slurry previously discharged from the vat if the actual vat level signal is less than the reference vat level signal.

11. A repulping apparatus comprising:

a vat for receiving and containing a pulp and water slurry; said vat having a rotatable rotor therein;

a dump chest containing slurry received from the vat for further process use;

level indicating means for sensing the deviation from a desired predetermined level of slurry in the dump chest and producing a dump chest signal representative of such deviation level which varies with the amount of deviation;

feed means responsible to the dump chest signal for moving the pulp into the vat;

feed indicating means for sensing the entry of pulp into the vat and producing a pulp entry signal indicating such entry; and controller means responsible to the pulp entry signal for controlling the admission of water in the vat such that the volume of the pulp and water slurry in the vat available to the dump chest enable the maintenance of the predetermined slurry level in the dump chest.

12. The repulping apparatus according to claim 11 wherein:

the feed means has a pulp moving speed which varies in proportion to the deviation variation of the dump chest signal;

the feed indicating means varies the pulp entry signal as the feed means pulp moving speed varies; and the controller means varies the admitting of water into the vat in response to variation in the pulp entry signal such that the volume of the slurry in the vat available to the dump chest is continuously variable in proportion to the amount of deviation of the level of slurry in the dump chest from the predetermined level.

13. The repulping apparatus according to claim 12 further comprising:

pipe means connected between the vat and the dump chest for conveying slurry from the vat to the dump chest;

consistency trim means for sensing the consistency of the slurry in the pipe means and producing an actual consistency signal representative of the slurry consistency;

consistency control means containing a reference consistency signal representative of a desired predetermined slurry consistency and being responsive to the actual consistency signal to compare the actual consistency signal and the reference consistency signal and produce a dilution signal if the actual consistency signal is greater than the reference consistency signal; and trim dilution valve means responsive to the dilution signal to add water to the slurry in the pipe means.

* * * * *